United States Patent [19]

Klietz

[11] 4,238,125

[45] Dec. 9, 1980

[54] PLATE FEEDING DEVICE FOR EMBOSSING MACHINES

[75] Inventor: Lothar R. Klietz, Gorxheimertal, Fed. Rep. of Germany

[73] Assignee: Pitney Bowes Deutschland GmbH, Berlin, Fed. Rep. of Germany

[21] Appl. No.: 39,627

[22] Filed: May 16, 1979

[30] Foreign Application Priority Data

May 31, 1978 [DE] Fed. Rep. of Germany ... 7816371[U]

[51] Int. Cl.[3] ..... B65H 3/24; B65H 1/22

[52] U.S. Cl. ..... 271/3; 271/131; 271/164; 271/165

[58] Field of Search ..... 271/3, 131, 162, 164, 271/165, 8

[56] References Cited

U.S. PATENT DOCUMENTS

| | | | |
|---|---|---|---|
| 3,531,104 | 9/1970 | Martin | 271/8 R |
| 3,993,300 | 11/1976 | Dehner | 271/131 X |

*Primary Examiner*—Richard A. Schacher

*Attorney, Agent, or Firm*—Peter Vrahotes; William D. Soltow, Jr.; Albert W. Scribner

[57] ABSTRACT

Feeding apparatus for embossing machines that produce printing plates for address printing machines, identification means, and the like, is provided with a plate carriage on which a plate holder is mounted. The arrangement is such that the printing plates can be moved into two directions which are perpendicular to each other. One of these directions serves for character spacing within a print or read line, the second direction serves for line spacing. A discharge mechanism is provided for conveniently removing printing plates from the apparatus after embossment thereof.

5 Claims, 1 Drawing Figure

PLATE FEEDING DEVICE FOR EMBOSSING MACHINES

BACKGROUND OF INVENTION

Embossing machines for embossing printing plates increasingly have to be automated in order to be adapted for being separately controlled, for example, as by being connected to an electronic computer or reading apparatus. For this purpose, it is necessary to arrange the passage of the plates through the embossing machine in such a manner that automated feeding and removal of the plates into and out of a plate holder is possible.

Moreover, in some cases it is desired that the plates will be automatically fed one after the other into the embossing machine; however, they should be removable individually in the case where only one printing plate is to be embossed. For instance, in a reception room of a hospital an embossed plate often has to be handed immediately to a patient for identification purposes.

SUMMARY OF THE INVENTION

According to the present invention, the above can be attained by placing adjacent to the sliding path of a plate holder in which plates are embossed a plate supply magazine or hopper for unembossed plates which hopper is attached to a plate carriage. A receiving desk is located on the other side of the sliding path for receiving the embossed plates.

Hence, the plate hopper is fixed to the plate carriage and follows its movements. The hopper, therefore, is located permanently adjacent the sliding path of the plate holder at the home position of the plate holder. As soon as the plate holder returns to this home position, when the embossing operation has been completed, the next plate is withdrawn automatically from the plate hopper and inserted into the plate holder. In addition, the plate which had just been embossed is simultaneously withdrawn from the plate holder. Thus, the next cycle for embossing can be started immediately. With the direction of feed being perpendicular to the sliding path of the plate holder, there will be only short travel distances and a simple construction can be attained. The embossed plate subsequently will be taken off, or guided from the receiving desk.

In the case, however, where the receiving desk is within a housing and is not accessible, a direct removal of the embossed plates from the receiving desk will not be possible. Appropriately, therefore, the receiving desk is a plate slide which is hinged and supported by a roller mounted with the housing. The pivot axis is arranged in a higher position than the roller. Thus, when the plate carriage is moved, the plate slide will be drawn over the roller with its free end located opposite the pivot axis. The plate slide will be in a nearly horizontal position at such time when the plate carriage is at an extreme location. During this operation, the next plate to be embossed will be withdrawn from the hopper by means of a driving pawl or control cam and inserted into the receiving trough of the plate holder, and the just embossed plate is driven out onto the now horizontally positioned plate slide. When the plate carriage is moved into the opposite direction, the pivot axis will approach the roller whereupon the free end of the plate slide will be lowered and the embossed plate will slide downwardly.

The plate slide may be formed so that its end distal from the pivot axis is provided with a stop for the embossed plate from which it could be removed. Because of the fact, however, that the plate slide is connected to the plate carriage, the operator would have to pay great attention in order to be able to take off the embossed plate just at the right moment. Therefore, it is more suitable to extend the plate slide to a stationary pick-up slide to which the embossed plate will be conveyed and on which the plate can remain during a new embossing cycle and movement of the plate carriage. Thus, the plate can be taken off at any time during the embossing operation of the next plate.

Moreover, the stationary pick-up slide is particularly suitable because the embossed plate can be guided, in a very simple manner, through the housing of the embossing machine. Because of the fact that this is a stationary part there will be no access to the moveable parts from outside the housing.

DETAILED DESCRIPTION OF THE PREFERRED EMBODIMENT

Figure 1:
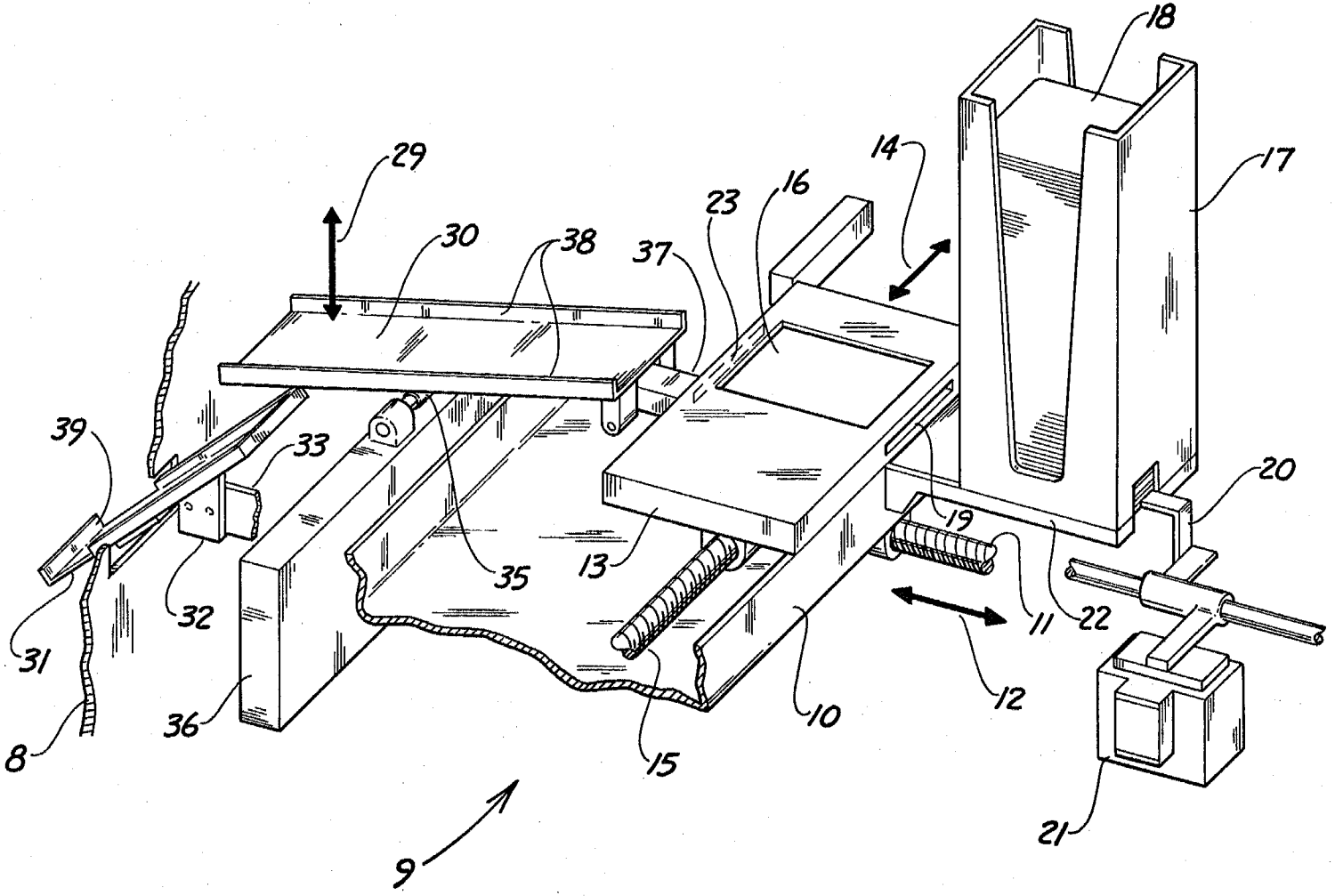
FIG. 1 of the drawing is a perspective view of a conveying apparatus that is part of an embossing machine and which illustrates the preferred embodiment of the invention.

Referring to the drawing, an embossing machine, which has a housing 8, is only outlined by the coordinate paths taken by a plate to be embossed. The conveying apparatus of the embossing machine is shown generally at 9 and includes a plate carriage 10 which can be reciprocally moved as indicated by the double arrow 12 by means of a lead screw 11 mounted within the housing 8. The plate carriage 10 carries a plate holder 13 which can be reciprocated through a sliding path along the plate carriage as indicated by the double arrow 14 by means of a lead screw 15 received within the plate holder and mounted by the plate carriage. On the upper surface of the plate holder 13 is a receiving trough 16 in which a plate to be embossed can be securely supported.

Adjacent to the sliding path of the plate holder 13 is a plate hopper 17 which is arranged on a side arm 22 fixed to the plate carriage 10. A stack of plates 18 is shown received within the hopper 17. The plate hopper 17 is arranged in such a manner that the bottommost plate 18 will be at the level of the bottom of the receiving trough 16. The bottommost plate 18 can be inserted into the receiving trough 16 through an inlet slot 19 of the receiving trough. This is accomplished by means of a driving pawl 20, the plane of movement of which coincides with the plane defined on the one hand by the bottommost plate 18 in the stack in the hopper 17 and on the other hand by the receiving trough 16. The operation of this driving pawl 20 is indicated only schematically in the drawing and it is actuated by an acutating magnet 21 by means of which the driving pawl 20 can be lifted and lowered. The pawl 20 will be in its lifted position when the plate carriage 10 is moved to the right as seen in the figure. The driving pawl 20 when lifted (as seen in the figure) will engage the bottommost plate to insert it into the receiving trough 16 when the plate hopper 17 is moved to the right and the hopper 17 passes over the cranked driving pawl 20 as will be apparent from the drawing.

Simultaneously, a plate 18 that already had been placed into the receiving trough 16, will be pushed through an outlet slot 23, which corresponds to and is in alignment with the inlet slot 19, onto a plate slide 30. The plate slide 30 is pivotably mounted on a connecting member 37 that is secured to and moves in unison with the plate carriage 10. In the drawing the plate carriage 10 is shown in its left end position. Thus the plate slide 30 is shown in its lowermost position, its movement into various positions being indicated by the double arrow 29. In the lowermost position, the free end of the plate 30, which is distal from the plate carriage 10, rests on the end of a pick-up slide 31 which extends through the housing 8. The pick-up slide 31 is fixed to a bracket 32 which is supported by the housing 8 by means of an angle iron 33. The plate slide 30 as well as the pick-up slide 31 are provided with side guiding flanges 38 which extend upwardly, and the pick-up slide 31 is provided, additionally, with a stop member 39 at its lower end for stopping the plates 18 which have passed from the plate holder 13 along the plate slide 30 and the pick-up slide 31 through the housing 8. Moreover, the pick-up slide 31 is provided with openings or cut-outs for easy removal of plates 18 located thereon.

During reciprocation of the plate carriage 10, the movement of the plate slide 30 (within the housing) in the direction of the double arrow 29 is automatically controlled by a roller 35 arranged parallel to the pivot axis of the plate slide 30. The roller 35 is located on a support 36 which is stationarily mounted in the housing 8. The roller 35 is arranged in a position somewhat lower than the pivot axis of the plate slide 30. Moreover, the bottom surface of the plate slide 30 can be provided with a cam-like guiding surface to increase the rate of lifting and lowering of the plate slide.

When the plate carriage 10 is moved to the right, the plate slide 30 is drawn over the roller 35 by a connecting member 37 that is secured to the plate carriage thereby carrying the plate slide 30. The plate slide 30 is thus pivoted in an upward direction into a substantially horizontal position as the plate carriage 10 is moved to the right as seen in the drawing. When the plate carriage 10 is moved to the left and into the position as illustrated in the drawing, the plate slide 30 will automatically tip into an inclined position.

With an unembossed plate received within the receiving trough 16, the plate holder 13 will be moved along the path indicated by the double arrow 14 by the turning of the lead screw 15 to deliver the plate to the embossing station (not shown) of the embossing machine. Upon completion of the embossing operation the plate holder 13 will be returned to its home position, whereupon the plate 18 will be removed from the receiving trough 16. During removal of an embossed plate 18 from the receiving trough 16 of the plate holder 13, the just embossed plate will be guided onto the plate slide 30. Such removal is accomplished by the pawl 20 being in an upright position, the plate carriage 10 being moved to the right to engage the lowermost plate 18 with the pawl, thereby driving the lowermost plate through the inlet slot 19 and into engagement with the plate supported within the receiving trough 16, whereby the incoming plate will drive the already embossed plate through the outlet slot 23 and onto the plate slide 30. The plate slide 30 serves as a receiving desk since during this phase of the operation and will be in its horizontal position. However, the plate 18 will not have to remain in this position until the next plate is completely embossed, but will be made accessible from the outside because of the automatic tipping of the plate slide 30. Due to the fact that the plate will be guided across the plate slide 30 to the pick-up slide 31, it will exit from the housing 8 to be accessible from the outside. This function can be automatically attained.

Even in the case where only one plate is embossed, this plate can be obtained immediately. This will be an advantage, for instance, in the reception room of a hospital, where the plates may be handed to patients immediately after having data embossed thereon. The conveying apparatus is particuarly useful in the case where the complete embossing mechanism is covered by a noise reducing bonnet in order to attain maximum noise reduction.

It will be appreciated that during the embossing operation, the pawl 20 will be lowered, the plate carriage 10 will move to accomplish spacing along a line, and the plate holder 13 moved incrementally along the sliding path 14 to obtain line spacing.

What is claimed is:

1. Plate feeding apparatus for embossing machines that produce embossed printing plates for address printing machines, identification means, and the like, comprising: a housing, a plate carriage movably mounted within said housing, a plate holder movably mounted on said plate carriage, said plate holder having a plate receiving trough therein, means for moving said plate holder along a first path, means for moving said plate carriage along a second path which is perpendicular to said first path between a first location and a second location, a plate hopper fixed to said plate carriage and an elongated plate slide having first and second ends, said first end of said plate slide being pivotably mounted to said plate carriage and adjacent to said first path.

2. Apparatus according to claim 1, wherein a roller is supported by said housing and said plate slide is disposed upon said roller.

3. Apparatus according to claim 2, wherein said plate slide extends subtantially parallel to the plane of the receiving trough of said plate holder when said plate carriage in said first location and said plate slide is inclined when said plate carriage is at said second location.

4. Apparatus according to claim 3, including a pick-up slide secured to said housing with one end adjacent to said second end of said plate slide, said pick-up slide being inclined downwardly as it extends from said plate slide.

5. Apparatus according to claim 4, wherein a portion of said pick-up slide extends outside said housing.

* * * * *